US005774769A

United States Patent [19]

Chigono et al.

[11] Patent Number: 5,774,769

[45] Date of Patent: Jun. 30, 1998

[54] CHARGING APPARATUS AND IMAGE FORMING APPARATUS

[75] Inventors: Yasunori Chigono, Susono; Jun Hirabayashi, Numazu, both of Japan

[73] Assignee: Canon Kabushiki Kaisha, Tokyo, Japan

[21] Appl. No.: 797,658

[22] Filed: Jan. 31, 1997

[30] Foreign Application Priority Data

Jan. 31, 1996 [JP] Japan ..... 8-037427

[51] Int. Cl.[6] ..... G03G 15/02

[52] U.S. Cl. ..... 399/176; 399/174; 361/225

[58] Field of Search ..... 399/174, 175, 399/176, 89; 361/225, 230, 235

[56] References Cited

U.S. PATENT DOCUMENTS

| | | | |
|---|---|---|---|
| 5,351,109 | 9/1994 | Haneda | 399/175 |
| 5,357,323 | 10/1994 | Haneda et al. | 399/175 |
| 5,367,365 | 11/1994 | Haneda et al. | 399/174 |
| 5,381,215 | 1/1995 | Haneda et al. | 399/174 |
| 5,426,489 | 6/1995 | Haneda et al. | 399/175 |
| 5,457,522 | 10/1995 | Haneda et al. | 399/176 |
| 5,475,472 | 12/1995 | Saito et al. | 399/115 |
| 5,579,095 | 11/1996 | Yano et al. | 399/175 |
| 5,592,264 | 1/1997 | Shigeta et al. | 399/175 |
| 5,596,394 | 1/1997 | Nishiguchi et al. | 399/175 |
| 5,659,852 | 8/1997 | Chigono et al. | 399/175 |

*Primary Examiner*—Matthew S. Smith
*Attorney, Agent, or Firm*—Fitzpatrick, Cella, Harper & Scinto

[57] ABSTRACT

A charging device includes a charging member contactable to said member to be charged to charge a member to be charged. Wherein a voltage is applicable to said charging member; a resistor provided in a charging circuit for applying the voltage to said charging member; wherein said resistor has a resistance not less than 0.5 times a resistance of said charging member; wherein a combined resistance of said charging circuit and said charging member is not more than $10^7$ Ω.

38 Claims, 4 Drawing Sheets

CHARGING APPARATUS AND IMAGE FORMING APPARATUS

FIELD OF THE INVENTION AND RELATED ART

The present invention relates to a charging apparatus comprising a charging member which can be placed in contact with an object to be charged, to charge the object. It is also related to an image forming apparatus.

Generally speaking, an image forming apparatus, for example, a copy machine or a printer, is based on an electrophotographic system, an electrostatic recording system, and the like, and employs an image forming process inclusive of a step for charging an image forming member such as an electrophotographic photosensitive member or an electrostatic dielectric recording member. Such an image forming apparatus employs a charger based on corona discharge (hereinafter, corona type charger) as means or a device for uniformly charging (inclusive of discharging) the image bearing member, that is, the object to be charged.

In order to charge the surface of an object using the corona type charger, the corona type charger is placed close to the object to be charged, and high voltage is applied to the corona type charger to generate a corona shower. The surface of the object to be charged is exposed to the corona shower, whereby it is charged to a predetermined polarity and a predetermined potential level.

In recent years, however, a contact type charging apparatus (direct charging apparatus) has come into practical use in a low to medium speed image forming apparatus or the like. This is because a contact type charging apparatus has advantages such as low ozone generation, low power consumption, and the like, over a corona type charger.

In the case of a contact type charging apparatus (hereinafter, contact type charging apparatus), a charging member is placed in contact with the surface of an object to be charged, and voltage of a predetermined level is applied to the charging member to charge the surface of the object to a predetermined polarity and a predetermined potential level. A contact type charging member is an electrically conductive member. It is in the form of an elastic roller (roller type charger), a blade (blade type charger), a magnetic brush (magnetic brush charger), a fur brush (fur brush charger), and the like. A magnetic brush charger comprises a support portion and a magnetic brush portion. The support portion doubles as a power supply electrode. The magnetic brush portion is formed of electrically conductive magnetic particles which are magnetically confined on the support portion. In order to charge an object, the magnetic brush portion is placed in contact with the object to be charged, and power is supplied to the support portion. A fur brush type charger comprises a support member, and an electrically conductive first bristle brush portion supported by the support portion. The support portion also doubles as a power supply electrode. In order to charge an object by the fur brush type charger, the electrically conductive fiber bristle brush portion is placed in contact with the object, and power is supplied to the supporting portion.

There are two contact type charging methods: a method in which an object is charged dominantly through electrical discharge, and a method in which an object is charged dominantly through direct injection of charge into the surface of the object to be charged.

One of the charge injection type methods is disclosed in Japanese Laid-Open Patent No. 3921/1994, for example. According to this patent, the surface of a photosensitive member as an object to be charged is provided with a charge injection layer, and in order to inject charge into the photosensitive member, a contact type charging member such as the aforementioned one is placed in contact with the surface of the photosensitive member while applying voltage to the charging member. More specifically, the charge injection layer is formed by coating an electrically conductive material on the surface of the photosensitive member. The electrically conductive material is composed of acrylic resin, and $Sn_2$, wherein $Sn_2$ is doped with antimony to render it electrically conductive, and is dispersed as electrically conductive filler in the acrylic resin.

Since the contact type charging method, such as the aforementioned method in which charge is directly injected, does not depend on electrical discharge, the surface of a photosensitive member can be charged to a predetermined potential level by applying to a contact type charging member, a DC voltage equivalent to the predetermined surface potential level for the photosensitive member. Further, the contact type charging method does not generate ozone. From the standpoint of the condition of the contact (contact substantially without any gap) between a contact type charging member and the surface of an object to be charged, it is desirable to employ the magnetic brush type charger or the fur brush type charger.

However, even though a charging apparatus based on a contact type charging method has advantages such as the aforementioned low ozone production and low power consumption, it has a problem in that it is rather sensitive to environmental conditions.

In other words, the performance of a contact type charging member is not stable against environmental changes; the resistance of a contact type charging member is dependent on environmental conditions, being liable to change. This change in the charging member resistance is liable to change the overall resistance of a charging circuit system, which is liable to change the charging performance. As is evident, the change which occurs in the deteriorating (charge failure) direction invites deterioration in the quality of the images outputted from an image forming apparatus.

In particular, when a contact type charging member is constituted of a magnetic brush, the aforementioned dependency of the charging member performance on environmental conditions is conspicuous. Also, when a contact type charging member is constituted of a magnetic brush, not only the aforementioned resistance fluctuation effected by environment causes the deterioration of the charging performance, that is, charge failure, but also, the potential level difference between the magnetic brush portion and an object to be charged is increased by the charging performance deterioration. As a result, the electrically conductive particles forming the magnetic brush portion are liable to be stripped from the magnetic brush portion and adhered to the object to be charged. This stripping of magnetic particles from the magnetic brush portion, and the subsequent magnetic particle adhesion to the object to be charged, become more conspicuous as the potential level difference between the magnetic brush portion and the object to be charged increases.

As the electrically conductive magnetic particles are stripped away from the magnetic brush portion, the magnetic brush portion becomes thinner, which leads to deterioration in charging performance and quality of the image outputted from an image forming apparatus. Further, if the stripped particles adhere to the surface of an image bearing member, they are liable to function as a barrier which interfaces with an image exposure process. Also, if they are carried to a developing means and mixed with developer, or are carried to a cleaning means, and contaminate it, they become a cause of the deterioration in the quality of an outputted image.

SUMMARY OF THE INVENTION

Accordingly, a primary object of the present invention is to provide a charging apparatus which is superbly resistant to environmental change, and an image forming apparatus compatible with such a charging apparatus.

Another object of the present invention is to provide a charging apparatus which maintains a desirable charging performance even when the resistance of a charging member varies, and an image forming apparatus compatible with such a charging apparatus.

Another object of the present invention is to provide a charging apparatus capable of preventing the electrically conductive particles, such as magnetic particles forming a magnetic brush type charging member placed in contact with an object to be charged, from adhering to the object to be charged.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1 (FIGS. 1–4)

(1) General structure of image forming apparatus

Figure 1:
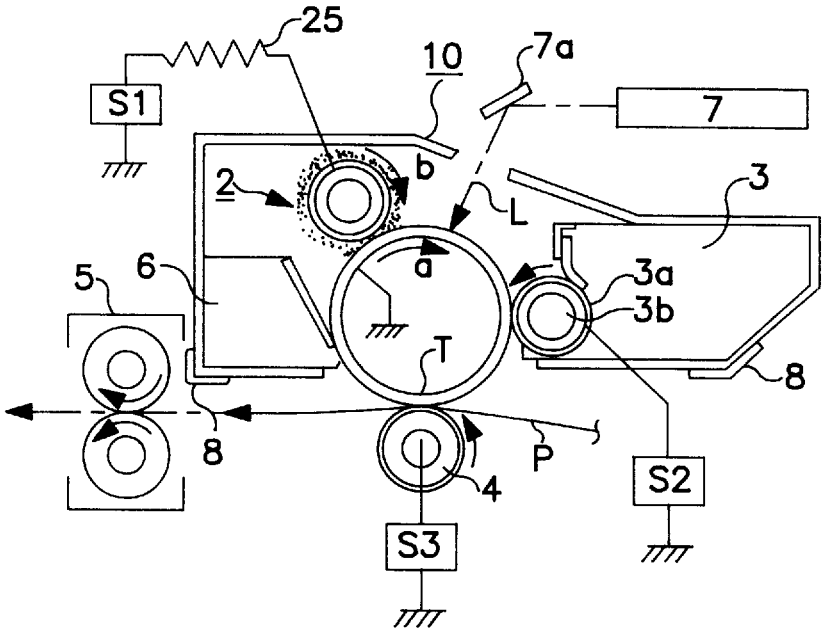
FIG. 1 is a schematic sectional view of the image forming apparatus in the first embodiment of the present invention, and depicts the structure thereof.

FIG. 1 is a schematic sectional view of an image forming apparatus in accordance with the present invention. The image forming apparatus in this embodiment is a laser beam printer which employs an electrophotographic printing system and a transfer system. Also, it employs a removably installable process cartridge.

A reference numeral 1 designates an electrophotographic photosensitive member as an image bearing member (object to be charged) in the form of a rotational drum. It is rotatively driven about an rotational axis in the clockwise direction indicated by an arrow mark a at a predetermined speed (process speed), which is 100 mm/sec in this embodiment. The photosensitive member in this embodiment is an OPC type photosensitive member whose surface layer constitutes a charge injection layer, which will be described in detail in Section (3).

A reference numeral 2 designates a contact type charging member for the photosensitive member 1. In this embodiment, it is a magnetic brush type charger, and is rotatively driven in the clockwise direction indicated by an arrow mark b. It is also a rotational sleeve type charger, which will be described in detail in Section (4).

To this magnetic brush type charger 2, a predetermined charge bias is applied from a charge bias application power source S1 through a resistive device (resistor) 25. In this embodiment, the charge bias is a DC voltage of −700 V, As the bias is applied, electrical charge is injected into the surface layer of the photosensitive member 1. As a result, the surface of the photosensitive member is directly charged to substantially the same potential level as the DC bias voltage level (−700 V) applied to the charger 2.

The charged surface of the photosensitive member is exposed to a scanning laser beam L projected from a laser scanner 7 as an exposing device. As a result, an electrostatic latent image corresponding to the image formation data for a target image is formed. The laser scanner 7 outputs a laser beam L having been modulated by serial, digital, picture element signals. An alphanumeric reference 7*a* designates a mirror which deflects the laser beam L toward an exposure station in which the rotating photosensitive member 1 is exposed to the laser beam L.

The electrostatic latent image formed on the photosensitive member surface is developed as a toner image by a developing device 3. In this embodiment, the developing device 3 is a reversal type developing device, in which toner is adhered to the areas correspondent to the light portions of the electrostatic latent image. An alphanumeric reference 3*a* designates a rotational development sleeve; 3*b*, a magnetic roller disposed within the developing sleeve 3*a*; and S2 designates a development bias application power source for the development sleeve 3*a*. The development sleeve 3*a* is disposed adjoining to the photosensitive member 1, holding a gap of 0.3 mm between its peripheral surface and the peripheral surface of the photosensitive drum, and is rotatively driven in the counterclockwise direction indicated by an arrow mark. As the development sleeve 3*a* is rotated, a thin layer of toner particles having been triboelectrically charged to the negative polarity is coated on the peripheral surface of the development sleeve 3*a*. As the development sleeve 3*a* is further rotated, the thin layer of negatively charged toner particles is conveyed toward a point (development station) at which the distance between the development sleeve 3*a* and the photosensitive drum 1 becomes shorter. To the development sleeve 3*a*, a development bias is applied from the development bias application power source S2 to generate an electric field. With the presence of the electric field, the toner particles on the development sleeve 3*a* are selectively attracted to the peripheral surface of the photosensitive drum 1, to the areas corresponding to the light areas of the electrostatic latent image. As a result, the electrostatic latent image is developed. In this embodiment, the development bias is a voltage composed by superposing a DC voltage of −500 V, and an AC (alternating) voltage having a frequency of 2.0 kHz and a peak-to-peak voltage of 1.6 kV.

The toner image formed on the surface of the photosensitive drum is conveyed to a transfer station T, which is a point at which the distance between the peripheral surface of the photosensitive drum 1 and the peripheral surface of a transferring device 4 becomes shortest. In the transfer station T, the toner image is transferred onto a recording material P delivered, with a predetermined timing, to the transfer station T from an unillustrated sheet feeder mechanism. The transferring device in this embodiment is a transfer roller placed in contact with the photosensitive member 1. As a transfer bias, that is, a voltage of a predetermined level, having a polarity opposite to the toner polarity is applied to the transfer roller 4 from a transfer bias application power source S3, the toner image on the surface of the photosensitive drum 1 is electrostatically transferred onto the surface of the recording material P delivered to the transfer station T.

The recording material P having received the toner image while it passed through the transfer station T is separated from the photosensitive drum surface, and is introduced into a fixing device 5, in which the toner image is fixed to the recording material P. Then, the recording material P with the fixed toner image is outputted, as a print, from the image forming apparatus.

After the separation of the recording material P, the surface of the photosensitive member 1 is cleared of adhesive residue such as the toner particles which have failed to be transferred, by a cleaning device 6, to be repeatedly used for image formation.

(2) Process cartridge 10

A reference numeral 10 designates a process cartridge removably installable into a predetermined space of the main assembly of a printer. The process cartridge 10 in this embodiment comprises four processing devices: a photosensitive drum 1 as an image bearing member, a magnetic brush type charger 2 as a contact type changing member, a developing device 3, and a cleaning device 6. They are integrally assembled into the cartridge housing, placing them in a manner to establish predetermined positional relationship among them. However, it is unnecessary for the cartridge 10 to comprise all of the aforementioned processing devices; it has only to comprise the photosensitive member 1, and at least one processing device among the charging device 2, developing device 3, and cleaning device 6.

As the process cartridge 10 is installed in a predetermined space within the printer main assembly, the process cartridge 10 and the printer main assembly are mechanically and electrically connected in a predetermined manner, readying the printer for an image forming operation. Reference numerals 8 and 8 designate a cartridge holder member which also doubles as a guide member for installing or removing the process cartridge 10. The power source S1 and the resistor 25 are disposed on the printer main assembly side.

Figure 2:
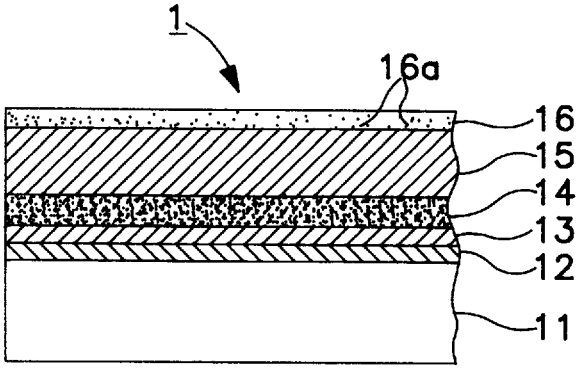
FIG. 2 is a vertical section of the surface layers of the photosensitive member illustrated in FIG. 1, and depicts the laminar structure thereof.

(3) Photosensitive member 1 (FIG. 2)

As described above, the photosensitive member 1 employed in this embodiment is an OPC type photosensitive member (organic photoconductive member) whose surface layer is a charge injection layer.

FIG. 2 is a schematic section of the surface layers of the photosensitive member 1. A reference numeral 11 designates an aluminum base in the form of a drum (A1 drum base). On the peripheral surface of the aluminum base, an undercoat layer 12, a positive charge rejection layer 13, a charge generation layer 14, and a charge transfer layer 15 are coated in layers in this order to form a typical OPC type photosensitive layer. On the photosensitive layer, a charge injection layer 16 is coated as the outermost surface layer.

The charge injection layer 16 in this embodiment is formed in the following manner. First, microscopic particles 16*a* of $Sn_2$ as electrically conductive particles (0.03 μm in diameter), lubricant such as tetrafluoroethylene resin (Teflon), polymerization initiator, and the like are mixed (dispersed) in photocurable acrylic resin. Then, the mixture is coated on the photosensitive layer, and cured with light to form the charge injection layer 16. The volumetric resistivity of the charge injection layer 16 is desirable to be in a range from $1\times10^9$ to $1\times10^{14}$ (ohm.cm). It is obtained as the volumetric resistivity for a sample of a sheet formed of the charge injection layer material. More specifically, the resistivity of the sample is measured by a High Resistance Meter 4329A (Yokogawa-Hewlette Packard) connected to Resistivity Cell 16008A, while applying a voltage of 100 V.

Further, nonorganic semiconductor such as CdS, Si or Se may be used as the material for the photosensitive layer.

Figure 3A:
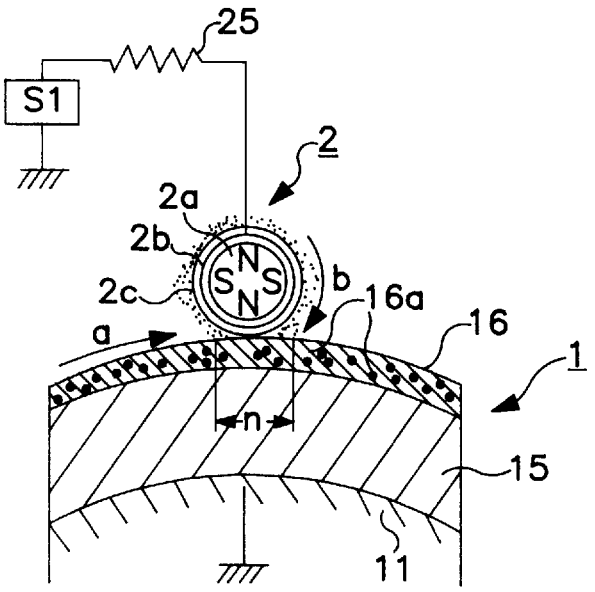
FIGS. 3(*a*) and 3(*b*) are a schematic vertical section of a charging system, and the equivalent circuit thereof, respectively.
Figure 3B:
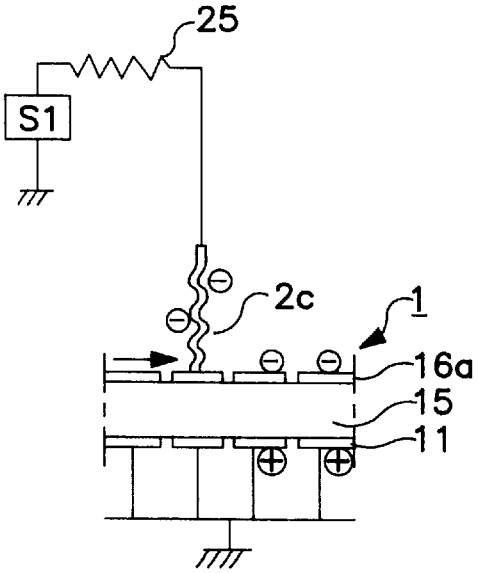

(4) Magnetic brush type charger 2 (FIG. 3)

FIG. 3(*a*) is a schematic section of the entirety of the charge circuit system, and FIG. 3(*b*) is the diagram of a circuit equivalent to the charge circuit system illustrated in FIG. 3(*a*).

The magnetic brush type charger 2 as the contact type charging member in this embodiment is of a rotary sleeve type. This magnetic brush type charger 2 comprises a fixedly supported nonrotational magnetic roller 2*a*, an electrically conductive, non-magnetic charging sleeve 2*b*, and a magnetic brush layer 2*c*. The charging sleeve 2*b* has an average surface roughness Ra of 1.2 μm, and is concentrically and rotatively fitted around the magnetic roller 2*a*. The magnetic brush layer 2*c* is formed of electrically conductive magnetic particles as the electrically conductive magnetic particles are adhered to the peripheral surface of the charging sleeve 2*b* by the magnetic force of the magnetic roller 2*a* disposed within the charging sleeve 2*b*.

The magnetic roller 2*a* employed in this embodiment has four poles which generate a magnetic flux in the radial direction of the charging sleeve 2*b*, wherein its peak magnetic flux density is 600 G at the surface of the charging sleeve 2*b*. It is fixedly supported in such a manner that one of the magnetic pole squarely faces the photosensitive drum 1.

The electrically conductive magnetic particles which are used to form the magnetic brush layer 2*c* in this embodiment are ferrite particles having an average diameter of 30 μm, a volumetric resistivity in the order of $1\times10^7$ (ohm/cm), and a saturation magnetization of 60 ($A.m^2/kg$).

The resistance of the electrically conductive magnetic particles is measured in the following manner; it is defined as the value obtained in the following manner. Two grams of electrically conductive magnetic particles are packed in a cylindrical container having a bottom surface area of 228 $mm^2$, and the current flowing through this system is measured while applying voltage in the longitudinal direction of the cylinder. Then, the resistance is calculated from the measured current value, and is normalized.

As for electrically conductive magnetic particles, metallic magnetic particles such as ferrite particles, or magnetite particles may be employed. Also, different types of metallic magnetic particles may be employed in mixture to improve chargeability. A volume resistivity of the charger is $10^6$ to $10^9$ Ω/cm. Alternatively, the resistance of the particle layer of the magnetic brush is $10^4$Ω to $10^7$Ω, and the volume resistivity of the particle layer is $10^6$ to $10^9$ Ω/cm. The resistance of the magnetic brush type charger 2 is desired to be no less than $10^4$Ω and no more than $10^7$Ω.

The average particle diameter of the electrically conductive magnetic particle is expressed in maximum horizontal chord length, and is measured using a microscope. More specifically, no less than 300 particles are randomly picked up, and their diameters are actually measured to calculate their mathematic average as the average particle diameter of the electrically conductive magnetic particle.

As for the equipment for measuring the magnetic characteristic of the electrically conductive magnetic particle, the automatic direct current magnetization B-H characteristic recording apparatus BHH-50 made by Riken Electric Co. Ltd. may be employed. When measuring the average particle diameter using this equipment, an approximately two grams of the electrically conductive magnetic particles are filled in a column-like container having an internal diameter of 6.5 mm and a height of 10 mm, and packed to prevent the particles from moving. Then, the saturation magnetization is obtained from the B-H curve thereof.

Both longitudinal end portions of the charging sleeve 2*b* are fitted with a spacer (unillustrated), so that when the magnetic brush type charger 2 with the above specification is disposed in contact with the photosensitive member 1, the peripheral surface of the charging sleeve 2*b* becomes parallel to the peripheral surface of the photosensitive member 1, and the gap between the two surfaces becomes 0.5 mm. With this arrangement, the magnetic brush layer 2*c* comes in contact with the surface of the photosensitive member 1, and forms a charging station n (contact area) having a predetermined width.

The rotational direction of the charging sleeve 2*b* in the nip region n is opposite to the rotational direction of the photosensitive member 1. The peripheral velocity of the charging sleeve 2*b* is the same as that of the photosensitive member 1, which is 100 mm/sec. As the charging sleeve 2*b* is rotated, the magnetic brush layer 2*c* is also rotated in the same direction, rubbing against the surface of the photosensitive member 1.

As a predetermined charge bias (in this embodiment, a DC voltage of −700 V) is applied from the charge bias application source S1 to the charging sleeve 2*b* of the magnetic brush type charger 2 through the resistor 25, charge is injected into the charge injection layer 16 of the photosensitive member 1 through the electrically conductive magnetic particles of the magnetic brush layer 2*c*, in the charging station n (photosensitive member 1 is charged). As a result, the surface of the photosensitive member 1 is charged to substantially the same voltage level as the voltage level of the aforementioned charge bias applied to the magnetic brush type charger 2.

When charging an object by charge injection, a contact type charging member is used to inject charge into the surface layer of the object (photosensitive member 1) which has surface resistance of an intermediary level. In this embodiment, in order to charge the photosensitive member 1, charge is not only injected into the traps of the surface layer material of the photosensitive drum 1, but also into the electrically conductive particles 16*a* ($Sn_2$) of the charge injection layer 16. Theoretically, the charge transfer layer 15, the drum-like aluminum base 11, and the electrically conductive particles 16*a* within the charge injection layer 16, constitute a microcondensor as is evident from the equivalent circuit of FIG. 3(*b*). In this case, the charge transfer layer 15 constitutes dielectric material, and the drum-like aluminum base 11 and the electrically conductive particles 16*a* constitute opposing electrode plates. The electrically conductive particles 16*a* are electrically independent from each other, each constituting a sort of microscopic floating electrode. In other words, macroscopically, the photosensitive member surface seems uniformly charged, but actually, the photosensitive member surface is covered with an infinite number of microscopic charged particles ($Sn_2$), each $Sn_2$ particle 16*a* being electrically independent from the others. This is thought to be the reason why the electrostatic latent image formed by exposing the surface of the photosensitive member 1 to the scanning layer beam L modulated by image does not immediately fade away.

(5) Charging performance stabilization by resistor (resistive device) 25

In this embodiment, a resistor 25 having a resistance close to, or larger than, the resistance of the magnetic brush type charger 2 as the contact type charging member is electrically connected in series to the charger 2. More specifically, the resistor 25 is serially disposed between the power source S1 and the magnetic brush type charger 2, being directly attached to the charge bias application power source S1. With this arrangement, the charge failure traceable to the environment dependent fluctuation of the resistance of the magnetic brush type charger 2 can be prevented. Also, the stripping of electrically conductive magnetic particles from the magnetic brush portion, and the subsequent adhesion of the stripped electrically conductive particles to the photosensitive member surface, which are traceable to the charging performance deterioration, can be prevented.

Figure 4:
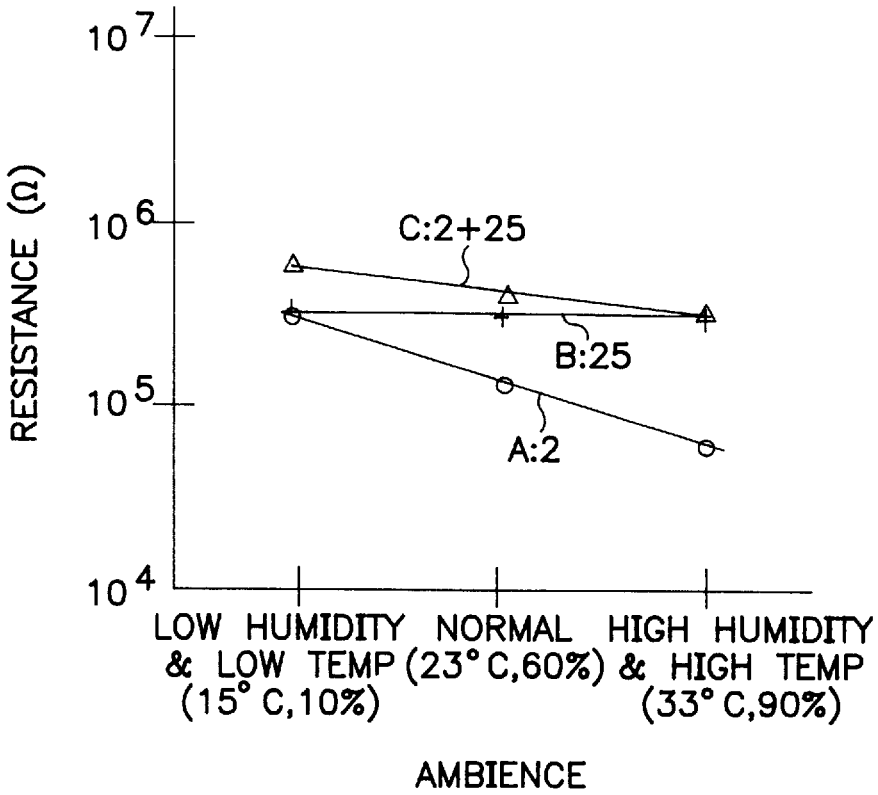
FIG. 4 is a graph which shows the resistances for a magnetic brush type charger alone, a resistor alone, and a combination of the serially connected magnetic brush type charger and resistor, which were measured while varying the condition of the environment in which the apparatus was used.

FIG. 4 is a graph which shows the resistance change of the magnetic brush type charger alone (A), the resistive device alone (B), and a combination (C) of the magnetic brush type charger 2 and the resistor 25 serially connected to the magnetic brush type charger 2, which was measured while changing the environment in which the apparatus was used.

As for the resistor 25, a resistive device in the form of a plate (FP=1 (500 kΩ), Japan Hydrazone Industry) was employed, but any other commonly available resistive device may be employed as long as it is heavily insulated and has a small temperature coefficient.

Referring to FIG. 4, the resistance of the magnetic brush type charger 2 alone substantially changes in response Lo the environmental change as shown by (A), but the resistance of the resistor 25 alone changes very little as shown by (B).

As shown by (C), in the case of the combined resistance of the magnetic brush type charger 2, and the resistor 25 which has substantially the same resistance as the magnetic brush type charger 2 and is serially connected to the magnetic brush type charger 2 and is serially connected to the magnetic brush type charger 2, change is smaller.

The resistance of the magnetic brush type charger 2 is measured in the following manner. The photosensitive member 1 in an image forming apparatus is replaced with an aluminum cylinder having the same configuration as the photosensitive member 1, and a voltage equal to the voltage applied when charging the photosensitive member 1 is applied between the magnetic brush type charger 2 and the aluminum cylinder to measure the current which flows between them, wherein the resistance value is derived from the measured current value.

When the resistance of the resistor device 25 is measured, a voltage of the same level as that applied to measure the resistance of the magnetic brush type charger 2 is applied between the two ends of the resistive element.

Therefore, in the case of the charging system comprising the magnetic brush type charger 2, and the resistor 25 having substantially the same level of resistance as that of the magnetic brush type charger 2 and being serially connected to the magnetic brush type charger 2, even when the resistance of the magnetic brush type charger 2 as the contact type charging member changes due to environmental change, the change is absorbed by the inserted resistor 25.

Therefore, even when the environmental conditions change, the overall resistance of the charging circuit system remains stable. In other words, the charging performance of the charging system comprising the magnetic brush type charger 2 and the resistor 25 is not dependent on environmental conditions, being therefore capable of always maintaining a predetermined level of charging performance.

Also, the separation of the electrically conducive magnetic particles from the magnetic brush portion traceable to the deterioration of the charging performance which is caused by the environmental change can be prevented or reduced. Consequently, the bad effects of the separation of the electrically conductive magnetic particles can be eliminated.

In comparison, in the case of a charging system constituted of the magnetic brush type charger 2 alone (comparative example A), when it was used under normal conditions (23° C., 60% RH), it displayed a desirable performance, and the adhesion of the electrically conductive magnetic particles to the photosensitive member surface is prevented. However, when the environment in which the image forming apparatus was used was a low temperature-high humidity environment (15° C., 10% RH), the resistance of the charging system increased, which deteriorated the charging performance. Further, the deterioration of the charging performance increased the potential level difference between the magnetic brush portion and the photosensitive member, causing increase in the adhesion of the electrically conductive magnetic particles to the photosensitive drum surface.

On the other hand, as the environmental conditions shifted in the high temperature-high humidity direction (33° C., 90% RH), the charging performance was desirable, but the resistance of the charging system became smaller, increasing the adhesion of the electrically conductive magnetic particles to the photosensitive member surface. As a result, charge failure occurred during an extended continuous printing operation, in particular toward the end of the continuous printing operation.

As is evident from the description of this embodiment, when the resistor 25 is connected between the magnetic brush type charger 2 and the voltage applying means S1 to stabilize the performance of a charging system against changes in environmental conditions, it is possible to reduce the degree of the dependency of the charging system performance upon environmental conditions. Therefore, desirable charging performance can be maintained under all environmental conditions. Also, it is possible to reduce the adhesion of the electrically conductive magnetic particles of the magnetic brush type charger 2 to the photosensitive member surface, which makes it possible to maintain satisfactory charging performance even during as extended continuous printing operation.

Table 1 presents performance evaluation results for this embodiment and the comparative example A, under various environmental conditions. In the table, N means "No good" and G means "Good".

TABLE 1

| | | LT & LH (15° C., 10% RH) | NORMAL (23° C., 60% RH) | HT & HH (33° C., 90% RH) |
|---|---|---|---|---|
| Emb. 1 | Initial charging performane | G | G | G |
| | Subsequent charging performance | G | G | G |
| | Adherence | G | G | G |
| Comp. A | Initial charging performance | G | G | G |
| | Subsequent charging performance | G | G | N |
| | Adherence | G | N | N |

The charging performance is evaluated in terms of the ghost which appears when the previously exposed surface area of the photosensitive member fail to be properly charged. As for the charging performance during an extended continuous printing operation, it is evaluated in terms of the charge ghost after printing 5,000 copies.

Evaluation of the electrically conductive magnetic particle adhesion was made in terms of evaluation of the bad effects which occur as the electrically conductive magnetic particles leave the magnetic brush type charger 2 and adhere to the photosensitive member 1. More specifically, it was a test of whether or not 5,000 copies could be made using a magnetic brush formed of a predetermined amount of the electrically conductive magnetic particles, that is, the initial amount of the magnetic particles which could be evenly borne by the entire peripheral surface of the charging sleeve.

The resistance of the resistor 25 in this embodiment was 50 kΩ. But, as long as the resistance of the resistor 25 was approximately no less than 0.5 times the resistance of the magnetic brush type charger 2, and at the same time, the combined resistance of the charging circuit for applying voltage to the charger, and the charger was no more than $10^7$, the charging performance could be maintained, and the electrically conductive magnetic particles were effectively prevented from adhering to the photosensitive member surface.

When the resistance of the resistor 25 was no more than 0.5 times the resistance of the magnetic brush type charger 2, the resistance of the charging system mainly came from the resistance of the magnetic brush type charger 2. Therefore, the dependency of the charging performance of the charging system upon the environmental condition cannot be suppressed. On the contrary, when the combined resistance of the charging circuit for applying voltage to the charger, and the charger itself, is no less than $10^7\Omega$, the resistance of the charging system becomes too high to provide a satisfactory charging performance.

Table 2 presents the results of the charging performance evaluation for the charging system, which were made while varying the resistance of the resistor 25.

The magnetic brush type charger 2 employed in this embodiment had a resistance value of approximately 100 kΩ ($10^5$). The charging performance and the adhesion of the electrically conductive magnetic particles were evaluated while changing the resistance of the resistor 25 from 10 kΩ to 100 MΩ. Table 2 presents the evaluations corresponding to the resistance values 10 kΩ (0.1 times the resistance value of charger 2), 50 kΩ (0.5 times the same), 500 kΩ (5.0 times the same), 10 MΩ (100.0 times the same), and 100 MΩ (1000.0 times the same), of the resistor 25. Again, in the table, N means "No good" and G means "Good".

TABLE 2

| RESISTANCE | PERFORMANCE | LT & LH (15° C., 10% RH) | NORMAL (23° C., 60% RH) | HT & HH (33° C., 90% RH) |
|---|---|---|---|---|
| 100 MΩ | Initial charging performance | N | N | G |
| | Subsequent charging performance | N | N | G |
| | Adherence | N | N | G |
| 10 MΩ | Initial charging performance | G | G | G |
| | Subsequent charging performance | G | G | G |
| | Adherence | G | G | G |
| 500 kΩ | Initial charging performance | G | G | G |
| | Subsequent charging performance | G | G | G |
| | Adherence | G | G | G |
| 50 kΩ | Initial charging performance | G | G | G |
| | Subsequent charging performance | G | G | G |
| | Adherence | G | G | G |
| 10 kΩ | Initial charging performance | G | G | G |
| | Subsequent charging performance | G | G | N |
| | Adherence | G | N | N |

When the resistance of the resistor 25 was 10 kΩ, the resistor 25 had very little effect in terms of compensating for the dependency of the resistance of the magnetic brush charger 2 upon environmental conditions. In other words, the evaluation for this setup was substantially the same as that for the setup in which the magnetic brush type charger 2 alone was employed. This is because the resistance value of the resistor 25 was too low, being lower than the resistance of the magnetic brush type charger 2 alone by one decimal point.

As is evident from the table, in order to compensate for the dependency of the resistance of the magnetic brush type charger 2 upon environmental conditions, the resistance of the resistor 25 is desirable to be no less than 0.5 time the resistance of the magnetic brush type charger 2.

When a resistor 25 having a resistance value of 100 MΩ ($10^8$Ω), which is rather high, was inserted, it was possible to prevent the combined resistance of the resistor 25 and the charger 2 from being affected by the change in environmental conditions. However, this setup made the resistance of the charging system too high to allow a sufficient amount of electrical current to flow to charge the photosensitive member 1, failing to deliver satisfactory charging performance even when environmental conditions were normal.

When a resistor 25 having such a resistance value that causes the combined resistance for the charging circuit for applying voltage to the charger, and the charger, to be no more than $10^7$ was inserted, the resistor 25 was effective to stabilize the charging performance, and prevent the electrically conductive magnetic particles from adhering to the photosensitive member surface.

As is evident from the above description, in the case of the structure according to this embodiment, the resistance of the charging system can be easily adjusted by adjusting the resistance of the resistor 25 alone, without changing the composition of the electrically conductive magnetic particles which forms the magnetic brush portion 2*c*. Therefore, the charging system structure according to this embodiment is easily applicable to various image forming apparatuses with different specifications. Further, the adjustment can be more easily done when a variable resistor is employed as the resistor 25.

Further, a fusible resistor may be employed as the resistor 25 to protect the magnetic brush type charger 2, the photosensitive member 1, or the voltage applying means S1 from excessive current which is liable to flow accidentally.

As described above, in this embodiment, the resistor 25 which is substantially immune to environmental change is serially connected to the magnetic brush type charger 2 whose resistance is dependent upon environmental change, to stabilize the resistance of the charging system against environmental change. Therefore, it is possible to maintain a desirable level of charging performance, and prevent the electrically conductive magnetic particles from adhering to the photosensitive member surface. As a result, high quality can be maintained even when image formation is continued for a long time.

Figure 5:
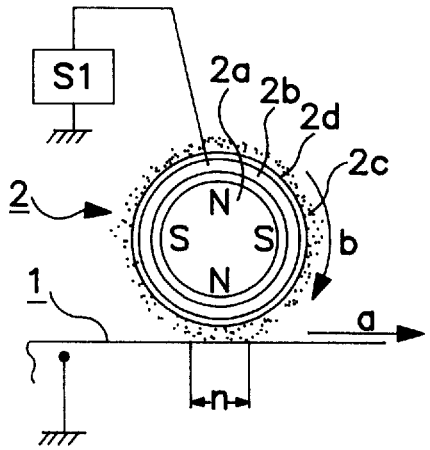
FIG. 5 is a schematic sectional view of the charging circuit system in the second embodiment.
Figure 6:
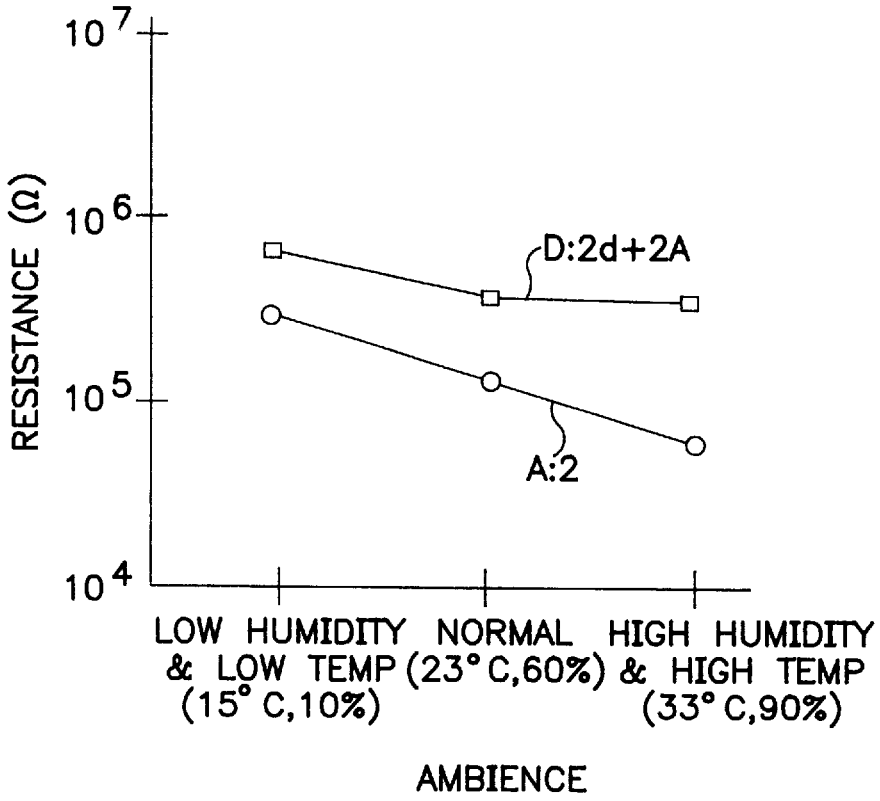
FIG. 6 is a graph which shows the resistive characteristics for a magnetic brush type charger provided with a resistance layer and a magnetic brush type charger, which were measured while varying the condition of the environment in which the apparatus was used.

Embodiment 2 (FIGS. 5 and 6)

In this embodiment, the resistor added to a charging circuit system is in the form of a resistive layer 2*d*, which uniformly covers the peripheral surface, that is, the magnetic brush layer supporting surface, of the charging sleeve 2*b* (electrode equivalent) of the magnetic brush type charger 2. The magnetic brush layer 2*c* formed of the electrically conductive magnetic particles is borne by the charging sleeve 2*b* as the power supply electrode equivalent, with the interposition of the resistor layer 2*d*, wherein power is supplied to the magnetic brush layer 2*c* through the resistor layer 2*d*.

Since the other sections of the charger structure are the same as those in the first embodiment, their descriptions will be omitted to avoid repetition.

As for the resistor layer 2*d*, a resistive material having a specific resistance of approximately $10^7$–$10^9$ ohm.cm is coated on the peripheral surface of the charging sleeve 2*b*. As for the resistive material, electrically conductive particles are dispersed in a hard binder such as silicone resin, acrylic resin, or polycarbonate resin, to adjust resistance, and then, this mixture is coated and dried. It is also possible to use a photocuring method or a thermo-curing method to form the resistor layer 2*d*.

In this embodiment, a ceramic coating method was used to render the resistor layer 2*d* durable, and also immune to environmental changes. For example, the resistance of an oxide such as alumina was adjusted, and melted with heat. Then, this melted material was coated on the peripheral surface of the charging sleeve having a diameter of 1.6 cm, to a thickness of 0.2 mm, to form the resistor layer 2*d* with desirable characteristics. The specific resistance of the thus formed resistor layer 2*d* was Approximately $2\times10^8$ Ω.cm.

The electrically conductive magnetic particles were magnetically adhered to a magnetic particle carrier member constituted of the resistor layer 2*d* and the charging sleeve 2*d*, to form the magnetic brush layer 2*c*. Thus, a magnetic brush type charger 2A with the resistor layer 2*d* was formed. Then, the resistance of this magnetic brush type charger 2A was measured while applying voltage between an electrically conductive cylinder having the same configuration as the drum which supported the photosensitive layer, and the magnetic brush type charger 2A, while varying environmental conditions. The results showed that the resistance change, which occurs as the environment in which the apparatus was used changes, was prevented by the presence of the resistor layer 2*d* which was substantially immune to environmental change.

FIG. 6 presents the results of the resistance measurement, and it confirms that in terms of resistance, the characteristic of the magnetic brush type charger 2A comprising the resistor layer 2*d* (D) is superior to the characteristic of the magnetic brush type charger 2 (A) not comprising the resistor layer 2*d* (comparative example A); in terms of immunity to environmental changes, the former is superior to the latter.

Table 3 shows the performance evaluations for the second embodiment of the present invention and the comparative example A, under various environmental conditions. Again, in the table, N means "No good" and G means "Good".

TABLE 3

| | | LT & LH (15° C., 10% RH) | NORMAL (23° C., 60% RH) | HT & HH (33° C., 90% RH) |
|---|---|---|---|---|
| Emb. 2 | Initial charging performance | G | G | G |
| | Subsequent charging performance | G | G | G |
| | Adherence | G | G | G |
| Comp. A | Initial charging performance | N | G | G |
| | Subsequent charging performance | N | G | N |
| | Adherence | N | G | N |

Table 3 confirms that the charging system in this second embodiment is superior to the comparative charging system A, in terms of the charging performance at the beginning of an image forming operation as well as during the operation thereafter, and also in terms of preventing the electrically conductive magnetic particles from adhering to the photosensitive member surface, regardless of the environment in which the image forming apparatus is used. This is because of the following reason. In comparison to the comparative charging system A which employs the magnetic brush type charger 2 without the resistor layer 2*d*, the peripheral surface of the charging sleeve 2*b* of the charging system in this second embodiment of the present invention is covered with the resistor layer 2*d* which is substantially immune to environmental change. Therefore, the resistance change of the charging system in the second embodiment is smaller than that of the comparative charging system A.

Further, since the surface of the charging sleeve 2*b* is uniformly covered with the resistor layer 2*d*, even when the photosensitive member 1 is defective, voltage does not drop; the charging device in this second embodiment displays strong immunity to the defect of the photosensitive member 1.

The resistor layer in this embodiment has a specific resistance of $2\times10^5$ (ohm.cm). Generally speaking, the resistance of the resistor layer 2*d* is desirable to be no less than 0.5 time the difference between the resistance of the magnetic brush type charger alone and the resistance of the resistor layer. Therefore, the material for the electrically conductive magnetic particles is desirable to be chosen to give the magnetic brush portion such a specific resistance and a configuration that puts the resistance of the magnetic brush type charger in the aforementioned resistance range. When the resistance of the resistor layer 2*d* is no more than 0.5 time the aforementioned resistance difference between the magnetic brush type charger alone and the resistor layer, the overall resistance of the charging system mainly comes from the magnetic brush portion. Therefore, it is impossible to suppress the resistance change of the charging system. Further, the resistance of the resistor layer 2*d* is desirable to be adjusted so that the combined resistance for the entire charging system and the charging circuit for applying voltage to the charger becomes no more than $10^7\Omega$. When this combined resistance is more than $10^7\Omega$, the overall resistance of the charging system becomes too high to offer satisfactory charging performance. In this embodiment, the resistance of the charging circuit for applying voltage to the charger is substantially zero. Therefore, the resistance of the charger is set to be no more than $10^7\Omega$. FIG. 4 presents the results of the evaluation of the charging system in this embodiment, wherein the charging system was evaluated while changing the specific resistance of the resistor layer to adjust the resistance of the resistor layer. Again, in the table, N means "No good" and G means "Good".

TABLE 4

| VOL. RES. OF RESISTOR LAYER (Ω.CM) | (CHARGER RESIS.)-(RESISTOR LAYER RESIS.) (Ω) | RESISTANCE (Ω) | PERFORMANCE | LT & LH (15° C., 10%) | NORMAL (23° C., 60%) | HT & HH (33° C., 90%) |
|---|---|---|---|---|---|---|
| $4\times10^{10}$ | 100k | 100M | Initial charging performance | N | N | G |
| | | | Subsequent charging performance | N | N | G |
| | | | Adherence | N | N | G |
| $4\times10^{9}$ | 100k | 10M | Initial charging performance | G | G | G |
| | | | Subsequent charging performance | G | G | G |
| | | | Adherence | G | G | G |
| $2\times10^{8}$ | 100k | 500K | Initial charging performance | G | G | G |
| | | | Subsequent charging performance | G | G | G |
| | | | Adherence | G | G | G |
| $2\times10^{7}$ | 100k | 50K | Initial charging performance | G | G | G |
| | | | Subsequent charging | G | G | G |

TABLE 4-continued

| VOL. RES. OF RESISTOR LAYER (Ω.CM) | (CHARGER RESIS.)-(RESISTOR LAYER RESIS.) (Ω) | RESISTANCE (Ω) | PERFORMANCE | LT & LH (15° C., 10%) | NORMAL (23° C., 60%) | HT & HH (33° C., 90%) |
|---|---|---|---|---|---|---|
| | | | performance | | | |
| | | | Adherence | G | G | G |
| $4 \times 10^6$ | 100k | 10K | Initial charging performance | G | G | |
| | | | Subsequent charging performance | G | G | N |
| | | | Adherence | G | N | N |

Miscellaneous Modifications of Embodiments (1) It is obvious that the usage of the contact type charging apparatus or charging member in accordance with the present invention does not need to be limited to charge only the image bearing member of an image forming apparatus as described in the preceding embodiments, and instead, it can be effectively employed as contact type means for charging a wide range of objects.

(2) Choice of the contact type charging device is not limited to the magnetic brush type charger described in the preceding embodiments. It may be a different type of charging device, for example, a charge roller formed of electrically conductive rubber or sponge, a fur brush type charger, a blade type charger, and the like. Further, it may be a non-rotational charger.

Furthermore, a magnetic brush type charger alone offers more choices, since there are different types of magnetic brush type chargers. For example, the contact type charger may be of a type which comprises a rotational magnetic roller 2*a*. In such a case, the surface of the magnetic roller 2*a* is treated to make it electrically conductive so that it can serve as a power supply electrode, wherein the magnetic brush layer 2*c* is formed by magnetically confining the electrically conductive magnetic particles directly only the treated surface. Also, the contact type charger may be a magnetic brush type charger of a non-rotational type.

(3) In the case of an injection type charging system, it is desirable that an object to be charged is provided with a surface layer having a resistance in a range of $10^9$–$10^{14}$ Ω.cm. However, the provision of the injection layer is not requisite when an object is charged mainly through electrical discharge; for example, the charge injection layer 16 illustrated in FIG. 2 may be eliminated.

(4) The means for exposing the photosensitive member surface, that is, the means for writing imaging information on the charged surface of the image bearing member of an image forming apparatus, is not limited to a scanning laser beam type exposing means, such as the one described in the embodiments of the present invention, which digitally forms a latent image. It may be an ordinary exposing means of an analogue type, a light emitting element such as an LED, a combination of a light emitting element such as a fluorescent lamp and a liquid crystal shutter. In other words, any exposing means is acceptable as long as it is capable of forming an electrostatic latent image which accurately reflects image data.

The image bearing member may be a dielectric member on which image data is electrostatically recordable. In the case of such a dielectric member, the surface of the dielectric member is uniformly charged to a predetermined polarity and a predetermined potential level by a primary charger, and then, the charge is selectively removed by a discharging means such as a discharging head (needle) or an electron gun to write the electrostatic latent image of a target image.

A method or means for developing an electrostatic latent image may be optionally selected. It may be a normal developing means instead of the reversal developing means employed in the preceding embodiments, which should be obvious.

(5) The transferring method does not need to be limited to the roller type transferring method described in the preceding embodiments. It may be any other contact type transfer charging system such as a blade type transferring method. Also, a transfer drum, a transfer belt, or an intermediary transfer member may be employed to form a multicolor image or a full-color image as well as a monochrome image by a multistep transferring method.

(6) The process cartridge structure does not need to be the same as that of the process cartridge 10 described in the preceding embodiments; it may comprise an optional combination of the aforementioned processing devices. For example, a process cartridge may comprise a combination of the image bearing member 1 and the contact type charging member 2, a combination of the image bearing member 1 and the developing device and/or the cleaning device 6, a combination of the image bearing member 1, the contact type charging device 2, and the developing device 3 and/or the cleaning device 6.

(7) In some display apparatuses, a toner image correspondent to the image formation data of a desired image is formed on the electrophotographic photosensitive member or the electrostatically recording dielectric member as an image bearing member in the form of a rotational endless belt, through the charging step, the image forming step, and the developing step, wherein their toner forming station is disposed in their display section so that the toner image formed on the image bearing member is displayed on their display screens. Also in this case, their image bearing member is repeatedly used to form the image to be displayed. Such display apparatuses are also included among the image forming apparatuses in accordance with the present invention.

While the invention has been described with reference to the structures disclosed herein, it is not confined to the details set forth and this application is intended to cover such modifications or changes as may come within the purposes of the improvements or the scope of the following claims.

What is claimed is:

1. A charging device comprising:

a charging member contactable to a member to be charged so as to charge said member to be charged, wherein a voltage is applicable to said charging member;

a resistor provided in a charging circuit for applying the voltage to said charging member;

wherein said resistor has a resistance not less than 0.5 times a resistance of said charging member;

wherein a combined resistance of said charging circuit and said charging member is not more than $10^7$ Ω.

2. A device according to claim 1, wherein a resistance of said charging circuit is provided by said resistor.

3. A device according to claim 1, wherein said resistor is connected electrically in series between said charging member and a voltage source.

4. A device according to claim 1, wherein said resistor is a fuse resistor.

5. A device according to claim 1, wherein said resistor is a variable resistor.

6. A device according to claim 1, 2, 3, 4 or 5, wherein said charging member includes an electroconductive particle layer contactable to said member to be charged and an electroconductive particle carrying member carrying the electroconductive particle layer.

7. A device according to claim 6, wherein electroconductive particles of said electroconductive particle layer are a magnetic particles, and said charging member includes a magnet inside said carrying member.

8. A device according to claim 6, wherein a volume resistivity of said electroconductive particle layer is $10^6$ to $10^9$ Ω/cm.

9. A device according to claim 6, wherein a resistance of said electroconductive particle layer is not less than $10^4$ Ω and less than $10^7$ Ω.

10. A device according to claim 1, wherein a volume resistivity of said charging member is $10^6$ to $10^9$ Ω/cm.

11. A device according to claim 1, wherein a resistance of said charging member is not less than $10^4$ Ω and less than $10^7$ Ω.

12. A charging device comprising:

a charging member contactable to a member to be charged so as to charge said member to be charged;

wherein said charging member includes an electroconductive particle layer contactable to said member to be charged and an electroconductive particle carrying member carrying the electroconductive particle layer;

wherein said electroconductive particle carrying member includes an electrode member capable of being supplied with a voltage and a resistance layer provided between said electrode member and said electroconductive particle layer;

wherein said resistance layer has a resistance not less than one half a difference between a resistance of said charging member and that of said resistance layer;

wherein a combined resistance of said charging member and a charging circuit for applying the voltage to said electrode member is not more than $10^7$ Ω.

13. A device according to claim 12, wherein the resistance of said charging circuit is substantially negligible resistance.

14. A device according to claim 12, wherein the difference between the resistance of said charging member and that of the resistance layer is a resistance of said electroconductive particle layer.

15. A device according to claim 12, wherein a volume resistivity of said electroconductive particle layer is $10^6$ to $10^9$ Ω/cm.

16. A device according to claim 12, wherein a resistance of said electroconductive particle layer is not less than $10^4$ Ω and less than $10^7$ Ω.

17. A device according to claim 12, wherein electroconductive particles of said electroconductive particle layer are a magnetic particles, and said charging member includes a magnet inside said carrying member.

18. An image forming apparatus comprising:

an image bearing member;

a charging member contactable said image bearing member to charge said image bearing member;

wherein a voltage is applicable to said charging member;

a resistor provided in a charging circuit for applying the voltage to said charging member;

wherein said resistor has a resistance not less than 0.5 times a resistance of said charging member;

wherein a combined resistance of said charging circuit and said charging member is not more than $10^7$ Ω.

19. A device according to claim 18, wherein a resistance of said charging circuit is provided by said resistor.

20. A device according to claim 18, wherein said resistor is connected electrically in series between said charging member and a voltage source.

21. A device according to claim 18, wherein aid resistor is a fuse resistor.

22. A device according to claim 18, wherein said resistor is a variable resistor.

23. A device according to claim 18, wherein said charging member includes an electroconductive particle layer contactable to said member to be charged and an electroconductive particle carrying member carrying the electroconductive particle layer.

24. A device according to claim 23, wherein electroconductive particles of said electroconductive particle layer are a magnetic particles, and said charging member includes a magnet inside said carrying member.

25. A device according to claim 23, wherein a volume resistivity of said electroconductive particle layer is $10^6$ to $10^9$ Ω/cm.

26. A device according to claim 23, wherein a resistance of said electroconductive particle layer is not less than $10^4$ Ω and less than $10^7$ Ω.

27. A device according to claim 18, wherein a volume resistivity of said charging member is $10^6$ to $10^9$ Ω/cm.

28. A device according to claim 18, wherein a resistance of said charging member is not less than $10^4$ Ω and less than $10^7$ Ω.

29. A device according to any one of claims 18–28, wherein said image bearing member is provided with a surface charge injection layer into which electric charge is injected through a contact portion with said charging member, and a volume resistivity of said charge injection layer is $1\times10^9$ to $1\times10^{14}$ Ωcm.

30. A device according to claim 29, wherein said image bearing member is provided with an electrophotographic photosensitive layer inside said charge injection layer.

31. An image forming apparatus comprising:

an image bearing member;

a charging member contactable said image bearing member to charge said image bearing member;

wherein said charging member includes an electroconductive particle layer contactable to said image bearing member and an electroconductive particle carrying member carrying said electroconductive particle layer;

wherein said electroconductive particle carrying member includes an electrode member capable of being supplied with a voltage and a resistance layer provided between said electrode member and said electroconductive particle layer;

wherein said resistance layer has a resistance not less than one half a difference between a resistance of said charging member and that of said resistance layer;

wherein a combined resistance of said charging member and a charging circuit for applying the voltage to said electrode member is not more than $10^7$ Ω.

32. A device according to claim 31, wherein the resistance of said charging circuit is substantially negligible resistance.

33. A device according to claim 31, wherein the difference between the resistance of said charging member and that of the resistance layer is a resistance of said electroconductive particle layer.

34. A device according to claim 31, wherein a volume resistivity of said charging member is $10^6$ to $10^9$ Ω/cm.

35. A device according to claim 31, wherein a resistance of said electroconductive particle layer is not less than $10^4$ Ω and less than $10^7$ Ω.

36. A device according to claim 31, wherein electroconductive particles of said electroconductive particle layer are a magnetic particles, and said charging member includes a magnet inside said carrying member.

37. A device according to any one of claims 31–36, wherein said image bearing member is provided with a surface charge injection layer into which electric charge is injected through a contact portion with said charging member, and a volume resistivity of said charge injection layer is $1\times10^9$ to $1\times10^{14}$ Ω/cm.

38. A device according to claim 37, wherein said image bearing member is provided with an electrophotographic photosensitive layer inside said charge injection layer.

* * * * *

UNITED STATES PATENT AND TRADEMARK OFFICE

CERTIFICATE OF CORRECTION

PATENT NO. : 5,774,769

DATED : June 30, 1998

INVENTORS : Yasunori Chigono, et al.

It is certified that error appears in the above-identified patent and that said Letters Patent is hereby corrected as shown below:

ON THE COVER

Under [56] References Cited, please insert

--FOREIGN PATENT DOCUMENTS 6-3921 1/1994 Japan--.

COLUMN 1

Line 61, "dominantly" should read --predominantly--; and
Line 63, "dominantly" should read --predominantly--.

COLUMN 6

Line 39, "pole" should read --poles--.

COLUMN 8

Line 36, "Lo" should read --to--.

COLUMN 9

Line 52, "as" should read --an--.

COLUMN 10

Line 19, "fail" should read --fails--.

UNITED STATES PATENT AND TRADEMARK OFFICE

CERTIFICATE OF CORRECTION

PATENT NO. : 5,774,769

DATED : June 30, 1998

INVENTORS : Yasunori Chigono, et al.

It is certified that error appears in the above-identified patent and that said Letters Patent is hereby corrected as shown below:

COLUMN 12

Line 57, "Approximately" should read --approximately--.

COLUMN 15

Line 37, "only" should read --onto--.

COLUMN 16

Table 4, under "HT & HH" and "G" and above "N", please insert --G--.

COLUMN 17

Line 15, "are a" should read --are--;
Line 61, "a magnetic" should read --magnetic--; and
Line 66, "contactable said" should read --contactable to said--;

COLUMN 18

Line 14, "aid" should read --said--;
Line 25, "a magnetic" should read --magnetic--; and
Line 50, "contactable" should read --contactable to--.

UNITED STATES PATENT AND TRADEMARK OFFICE

CERTIFICATE OF CORRECTION

PATENT NO. : 5,774,769

DATED : June 30, 1998

INVENTORS : Yasunori Chigono, et al.

It is certified that error appears in the above-identified patent and that said Letters Patent is hereby corrected as shown below:

COLUMN 20

Line 1, "a magnetic" should read --magnetic--.

Signed and Sealed this

Ninth Day of March, 1999

Q. Todd Dickinson

Q. TODD DICKINSON

*Acting Commissioner of Patents and Trademarks*

*Attest:*

*Attesting Officer*